US007104801B1

(12) United States Patent
Brodnick et al.

(10) Patent No.: US 7,104,801 B1
(45) Date of Patent: Sep. 12, 2006

(54) ARRANGEMENT FOR MANAGEMENT OF LEAD WIRES

(75) Inventors: Donald E. Brodnick, Cedarburg, WI (US); Marvin J. Zellmer, New Berlin, WI (US)

(73) Assignee: The General Electric Company, Schenectady, NY (US)

( * ) Notice: Subject to any disclaimer, the term of this patent is extended or adjusted under 35 U.S.C. 154(b) by 0 days.

(21) Appl. No.: 11/070,590

(22) Filed: Mar. 2, 2005

(51) Int. Cl.
*H01R 11/30* (2006.01)

(52) U.S. Cl. ..... 439/38; 600/394; 439/909

(58) Field of Classification Search ..... 439/528, 439/593, 909, 594, 701, 717, 502, 284; 600/394
See application file for complete search history.

(56) References Cited

U.S. PATENT DOCUMENTS 4,040,697 A 8/1977 Ramsay et al.
4,063,352 A * 12/1977 Bevilacqua ..... 29/884
4,072,388 A 2/1978 Dunn
4,178,052 A 12/1979 Ekbom et al.
4,200,348 A 4/1980 Stupay
4,220,387 A 9/1980 Biche et al.
4,317,278 A 3/1982 Carmon et al.
4,384,752 A * 5/1983 Gabriel ..... 439/38
4,385,793 A 5/1983 Koford et al.
4,685,467 A 8/1987 Cartmell et al.
4,702,256 A 10/1987 Robinson et al.
4,707,043 A * 11/1987 Reed ..... 439/142
4,815,964 A 3/1989 Cohen et al.
5,191,887 A 3/1993 Cartmell
5,405,273 A 4/1995 Cartmell et al.
5,454,739 A 10/1995 Strand
5,470,253 A * 11/1995 Siems et al. ..... 439/491
5,511,548 A 4/1996 Riazzi et al.
5,560,358 A 10/1996 Arnold et al.
5,582,180 A 12/1996 Manset et al.
5,813,979 A 9/1998 Wolfer
5,944,562 A 8/1999 Christensson
6,064,901 A 5/2000 Cartmell et al.
6,134,477 A 10/2000 Knuteson
6,276,054 B1 8/2001 Cartmell et al.
6,354,887 B1 * 3/2002 Maeda ..... 439/701
6,400,975 B1 6/2002 McFee
6,415,169 B1 7/2002 Kornrumpf et al.
6,453,186 B1 9/2002 Lovejoy et al.
6,457,984 B1 10/2002 Montgomery et al.
6,622,051 B1 * 9/2003 Bishay et al. ..... 607/116

(Continued)

FOREIGN PATENT DOCUMENTS

WO 94/01901 1/1994

(Continued)

*Primary Examiner*—P. Austin Bradley
*Assistant Examiner*—Larisa Tsukerman
(74) *Attorney, Agent, or Firm*—Andrus, Sceales, Starke & Sawall, LLP

(57) ABSTRACT

An arrangement for preventing lead wires on a patient monitoring or treatment device from becoming tangled. The arrangement comprises a plurality of electrically conductive lead wires, each having a fixed end and a free end, the fixed end being electrically coupled to the patient monitoring or treatment device. A mating connector is coupled to the free end of each of the plurality of electrically conductive lead wires. Each mating connector is electrically mateable with an electrode and also mateable with another mating connector to attach the free ends of at least two of the plurality of electrically conductive lead wires together. In one embodiment, a mounting member is provided that includes means for releasably connecting the mating connectors to store the mating connectors during periods of non-use.

11 Claims, 4 Drawing Sheets

U.S. PATENT DOCUMENTS

| | | | | |
|---|---|---|---|---|
| 6,639,153 | B1 * | 10/2003 | Hauge | 174/135 |
| 2002/0019166 | A1 | 2/2002 | Ubby et al. | |
| 2002/0099277 | A1 | 7/2002 | Harry et al. | |
| 2003/0036788 | A1 | 2/2003 | Coe et al. | |

FOREIGN PATENT DOCUMENTS

| | | |
|---|---|---|
| WO | 01/13791 | 3/2001 |

* cited by examiner

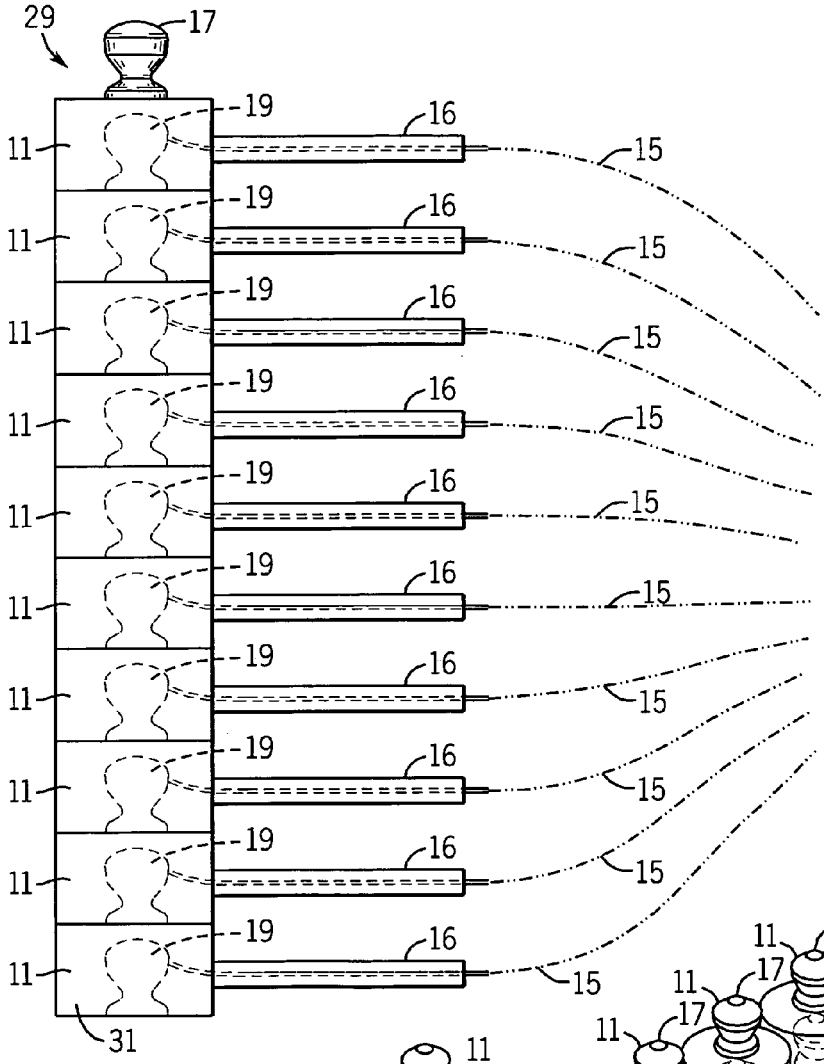
FIG. 3
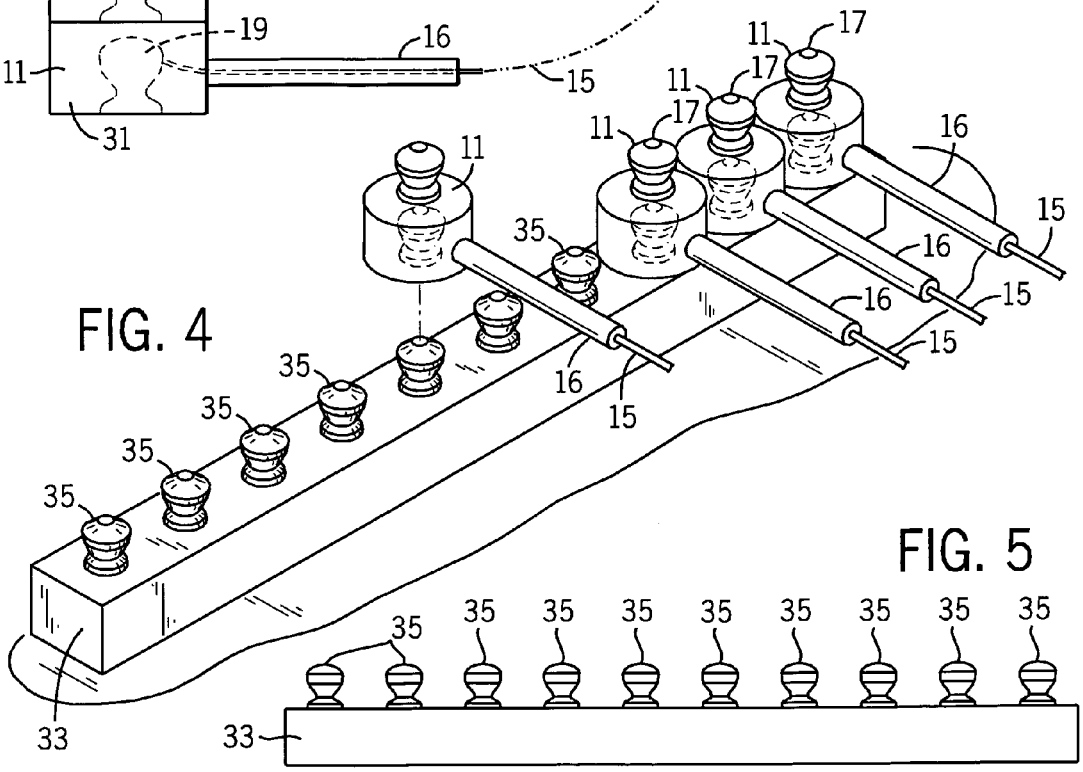
FIG. 4
FIG. 5

ARRANGEMENT FOR MANAGEMENT OF LEAD WIRES

FIELD OF THE INVENTION

The present invention relates to lead wires for patient monitoring or treatment devices such as, for example, electrocardiograph acquisition systems, and more specifically to a method and apparatus for preventing lead wires on the patient monitoring/treatment device from becoming tangled.

BACKGROUND OF THE INVENTION

Many known patient monitoring or treatment devices are electrically operated and include electrical leads or wires that interconnect various elements of the devices. For example, lead wires often interconnect a patient monitor with a portion of a device that interacts with the patient, such as electrodes. During use, disposable electrodes are attached to electrical snaps provided at the free end of the lead wire and the electrodes are then attached to the patient's body. During periods of non-use, the electrodes are removed from the snaps and the lead wires and snaps are either allowed to hang free from the monitoring/treatment device or are stored in an alternate location.

A common problem associated with lead wires is that they often become tangled or intertwined and thus prevent or hinder the caregiver in administering the treatment/monitoring services to the patient. In addition, often the lead wires are not completely untangled prior to attachment to the patient, which results in the usable length of the lead wires being reduced. Tangled lead wires can increase the time necessary to attach the electrodes to the patient. Reducing the effective lead wire length can also increase the likelihood that lead wires will pull against the electrodes and cause artifacts in ECG recordings or cause either the electrodes to separate from the body or the lead wires to separate from the electrodes.

It is known to provide gathers or retainers to hold a group of lead wires together at selected points. However, these arrangements limit the flexibility of the lead wires to be routed to different parts of the body. For example, a right arm lead wire and a left arm lead wire cannot be gathered within about 12 inches of the free ends of the lead wires, or else the free ends cannot reach the patient's opposite shoulders or wrists.

Another solution to the several problems noted above is provided in U.S. Pat. No. 6,639,153, which teaches a device for detangling or preventing the tangling of a plurality of elongated lead wires. When the lead wires become tangled, a slidable collar is slid along the length of the lead wires from a fixed end to a free end. Movement of the collar along the lead wires causes the wires to become segregated and thus disentangled. However, a disadvantage of this arrangement is that if the free ends of the lead wires are somewhat tangled or knotted, it will not be possible to slide the collar along the entire length of the lead wires. This arrangement also suffers from the disadvantages discussed above regarding gathers and retainers.

As such, it remains desirable to provide a method and apparatus for disentangling lead wires on a patient monitoring or treatment device. It is further desirable to provide such a method and apparatus that is simple to use and inexpensive to manufacture. It is further desirable to provide such an arrangement and method that promotes quick, organized and easy storage of the lead wires such that they are easily accessible.

SUMMARY OF THE INVENTION

The present invention provides a method and apparatus for preventing lead wires on a patient monitoring/treatment device from becoming tangled. The invention is simple to use and inexpensive to make and promotes quick, organized and easy storage of lead wires such that they are easily accessible.

In a preferred embodiment, the arrangement comprises a plurality of electrically conductive lead wires, each having a fixed end and a free end, wherein the fixed end is electrically coupled to a patient monitoring or treatment device. A mating connector is coupled to the free end of each of the plurality of electrically conductive lead wires. Each mating connector is electrically mateable with an electrode and also is mateable with at least one other mating connector. The mating between the pair of mating connectors attaches the free ends of at least two of the plurality of electrically conductive lead wires together. The mating connector may include a non-conducting post that is mateable with either the electrically conducting socket on another of the mating connectors or a cavity in the connector designed to receive the non-conducting post.

In another embodiment of the invention, the arrangement comprises a mounting member that has means for releasably connecting to the mating connectors to store the mating connectors in an organized manner during periods of non-use.

In an alternate embodiment, the arrangement includes the plurality of electrically conductive lead wires, each having a fixed end and a free end, the fixed end being electrically coupled to the patient monitoring or treatment device; and further includes means for releasably coupling the free ends of the lead wires together to prevent the lead wires from becoming tangled during periods of non-use. In this arrangement, the means for releasably coupling the free ends of the lead wires may comprise a magnet attached to each lead wire. Alternatively, a magnet may be attached to one lead wire and a metal collar attached to the remaining lead wires.

BRIEF DESCRIPTION OF THE DRAWINGS

Preferred embodiments of the invention are described herein below with reference to the attached drawing figures, wherein:

FIG. 3 is a side view of a stack of interconnected mating connectors, each mating connector attached to a lead wire and connected to adjacent mating connectors;

FIG. 4 is a perspective view of a mounting member comprising a plurality of non-conductive posts;

FIG. 5 is a front view of the mounting member shown in FIG. 4;

DETAILED DESCRIPTION OF THE PREFERRED EMBODIMENTS

In the preferred embodiments of the present invention described in detail below, an arrangement for preventing lead wires on a patient monitoring or treatment device from becoming tangled is provided. It should be understood that the drawings and specification are to be considered an exemplification of the principles of the invention, which is more particularly defined in the appended claims. For example, although the drawings show mating connectors and mounting members having particular sizes and shapes, it is contemplated that the mating connector may comprise a variety of shapes and sizes beyond those specifically depicted herein.

Figure 1:
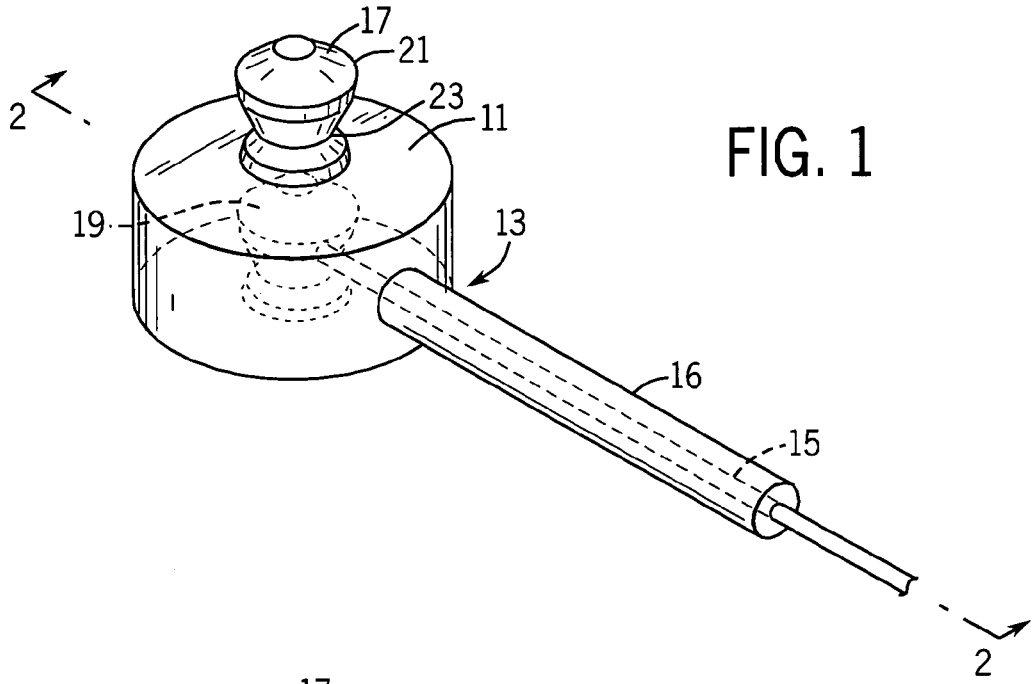
FIG. 1 is a perspective view of a first embodiment of a mating connector coupled to the free end of a lead wire.

As shown in FIG. 1, a mating connector 11 is attached to the free end 13 of a lead wire 15. Although not shown in the figures, the lead wire 15 further comprises a fixed end attached to a patient monitoring or treatment device, such as an electrocardiograph (ECG) machine. Alternately, the fixed end of the lead wire 15 may be attached to a larger multi-conductor cable (not shown). The lead wire 15 is wrapped in an insulating layer 16, as is common in the art. It should also be recognized that the present invention is applicable to different lead wire arrangements, such as those which employ lead wires having a shield conductor and second insulating layer.

Figure 2:
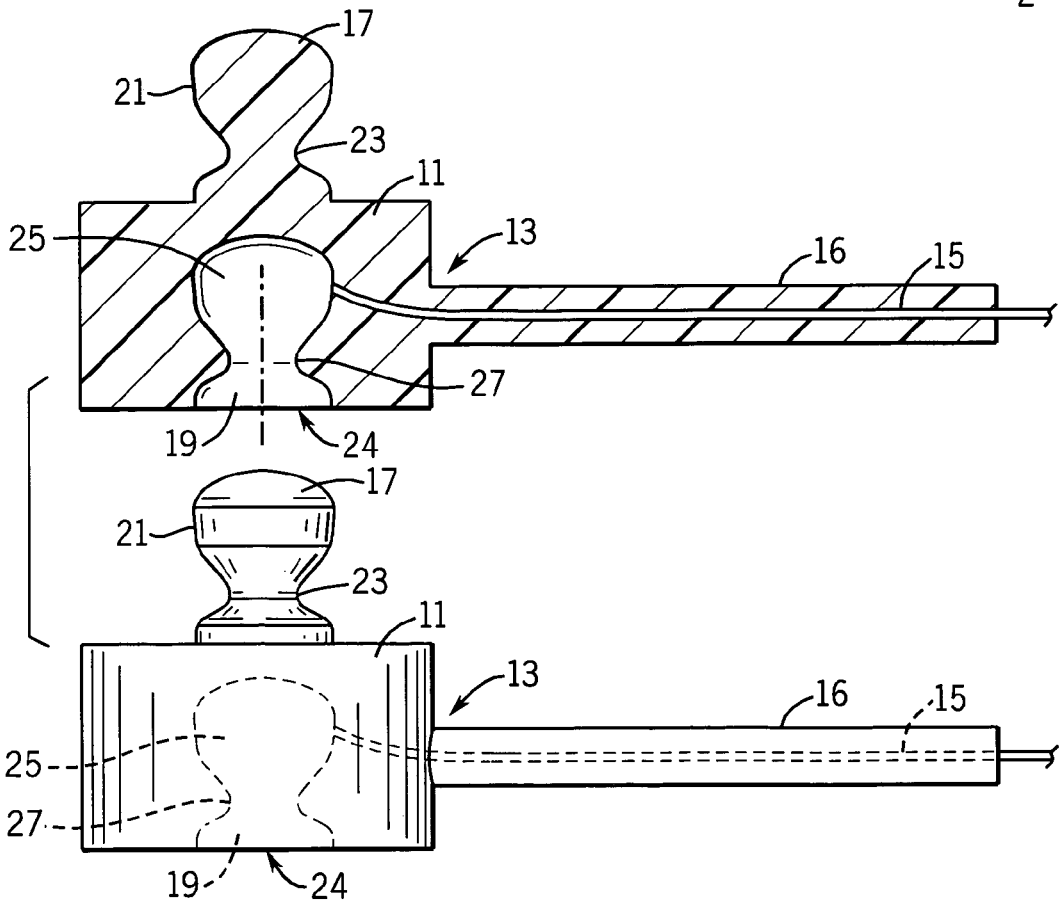
FIG. 2 is a sectional view of the mating connector and lead wire shown in FIG. 1 taken along line 2—2, and a side view of another mating connector and lead wire.

The mating connector 11 has an electrically conducting socket 19 that is mateable with an electrode (not shown) and that is in electrical communication with the lead wire 15, as is relatively common in the art. Preferably, the electrode received in the socket 19 is disposable and is configured for attachment to a patient. As shown in FIG. 2, the socket 19 includes an opening 24, an interior cavity 25 and a reduced diameter neck portion 27. In the embodiment shown, the socket 19 is sized and shaped to receive and releasably retain an electrically conductive post on an electrode (not shown) to place the electrode in electrical communication with lead wire 15 and thus the patient monitoring/treatment device. Although not shown in the drawings, the mating connector 11 may be labeled or color-coded according to any one of the standard electrode position color codes. Labels and color-coding facilitates placement of the mating connector 11 on the patient, as described herein below.

As shown in FIG. 1, the mating connector 11 also has a non-conducting post 17 that extends away from the connector 11 and is sized and shaped to mate with the electrically conducting opening 24 of another mating connector 11. More specifically, as shown in FIG. 2, the non-conducting post 17 has an upper portion 21 and a lower portion 23. The upper portion 21 is generally larger in diameter than the lower portion 23 and is sized to fit within the interior cavity 25 of the socket 19. That is, the shape of the post 17 conforms to, and is at least slightly smaller than the shape of the electrically conducting socket 19. In use, the upper portion 21 of the post 17 is inserted into the socket 19, past the neck portion 27, and into the cavity 25. The neck portion 27 of the socket 19 is at least sufficiently resilient to allow the upper portion 21 of the post to pass, but yet is at least sufficiently rigid to engage the lower portion 23 of the post 17 and retain the post within the socket 19.

As shown in FIG. 3, a stack 29 of mating connectors 11 can be attached together in the above manner during a period of non-use of the patient monitoring or treatment device. The stack 29 of mating connectors 11 form a single column such that when a caregiver desires to attach one of the mating connectors 11 to, for example, an electrode, the caregiver holds the stack 29 of connectors 11 in one hand, attaches an electrode to the bottom-most mating connector 31, separates the bottom-most mating connector 31 from the stack 29, and then attaches that electrode/mating connector 11 to the patient. The caregiver can attach the electrodes one at a time, with yet to be connected mating connectors 11 remaining in the stack 29, until all mating connectors 11 are attached to electrodes and then to the patient. When the particular monitoring or treatment procedure is complete, the mating connectors 11 are removed from the electrodes and reattached to each other, reforming the stack 29 of mating connectors 11.

A principle advantage of the arrangement of the present invention is that when the lead wires 15 are stored with the mating connectors 11 attached to each other, there is significantly less opportunity for the lead wires to become tangled. In addition, the mating connectors 43 can be stored in an order that corresponds to the various monitoring locations on the patient. For example, electrodes that are placed on various parts of the patient's body are stored together in sequence in the stack 29. The order of removal is thus the opposite the attachment order and for the next patient, the caregiver will encounter the mating connectors 11 in the same desired order.

Figure 6:
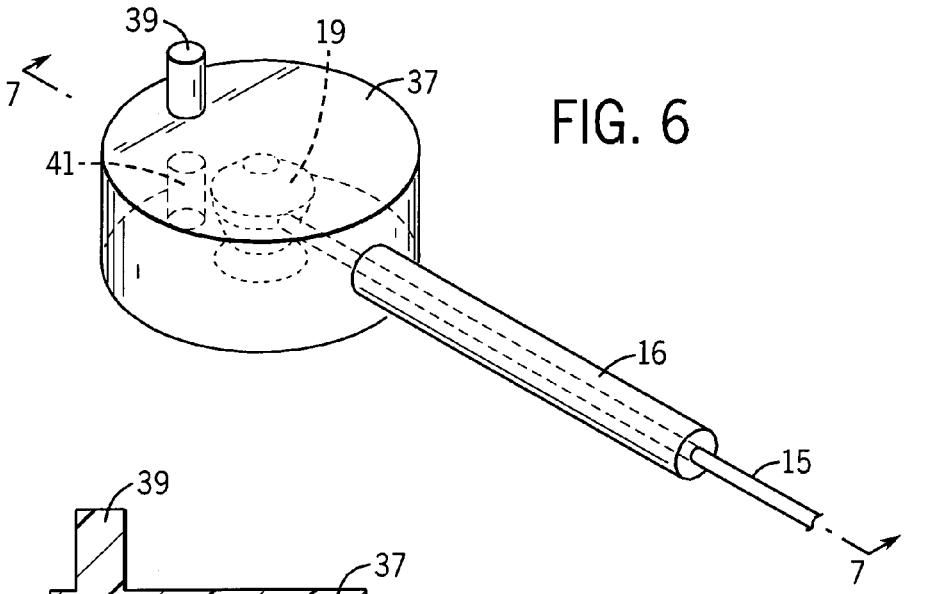
FIG. 6 is a perspective view of another embodiment of the mating connector.
Figure 7:
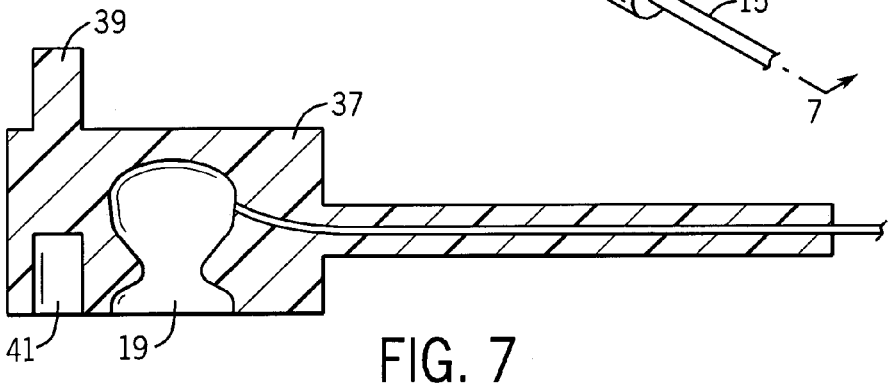
FIG. 7 is a sectional view of the mating connector taken along line 7—7 in FIG. 6.

Many equivalent designs and embodiments may be employed to mate the mating connectors together. For example, FIGS. 6 and 7 illustrate an alternate embodiment of the invention. The mating connector 37 has a non-conducting post 39 and a non-conducting cavity 41. The non-conducting post 39 extends from the mating connector 37 and has a substantially uniform diameter. The non-conducting cavity 41 is formed separate from the electrically conducting socket 19 and also has a substantially uniform diameter and is sized and shaped to receive the non-conducting post 39 to couple two or more mating connectors 37 together. More specifically, the non-conducting cavity 41 is sized slightly larger than the non-conducting post 39, such that the post 39 fits within and frictionally engages the cavity 41. It will thus be recognized that numerous mating connectors 37 can be joined together to form a stack of mating connectors 37 similar to that shown in FIG. 3.

Figure 8:
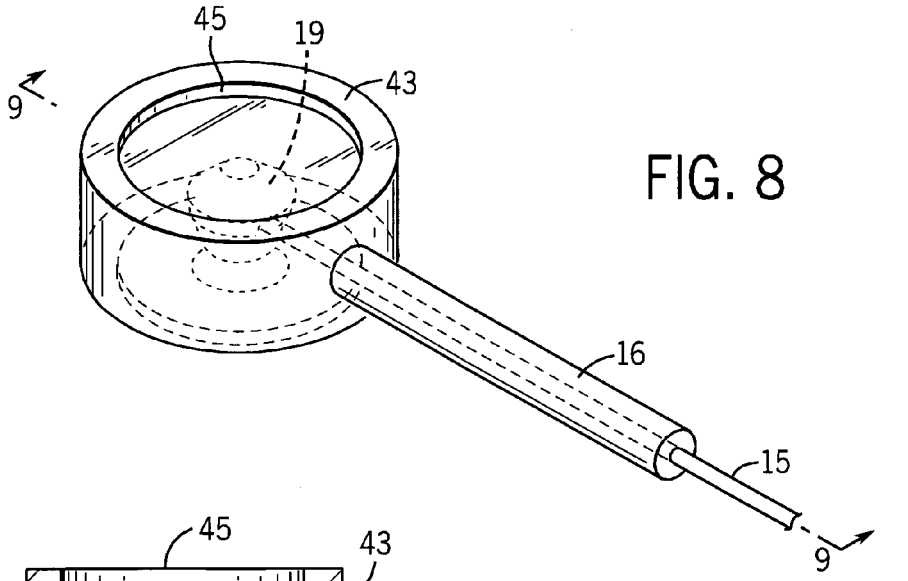
FIG. 8 is a perspective view of another embodiment of the mating connector.
Figure 9:
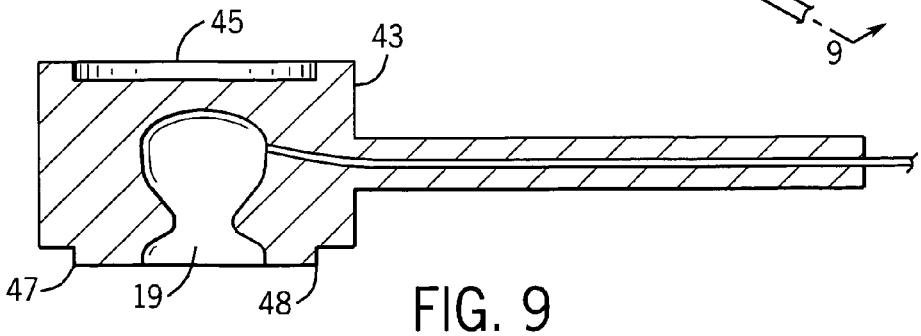
FIG. 9 is a sectional view of the mating connector taken along line 9—9 in FIG. 8.

As shown in FIGS. 8 and 9, an alternate embodiment of the invention is shown. More specifically, a mating connector 43 has a recess portion 45 and an extension 47. The extension 47 comprises an annular lip 48 that extends from the mating connector 43. The recess portion 45 is sized and shaped to receive the lip 48 of the lower extension 47 in a frictional engagement to releasably couple two of the mating connectors 43 together. It will also be recognized that numerous mating connectors 43 can be joined together to form a stack of mating connectors 43 similar to that shown in FIG. 3.

An additional feature of the invention is shown in FIGS. 4 and 5. More specifically, a mounting member 33 is provided for storing the mating connectors 11 during periods of non-use. The mounting member 33 has a series of non-conductive posts 35 that, as shown in FIG. 4, are of the same general shape and configuration as the non-conducting posts 17 shown in FIGS. 1–2. The posts 35 are sized and shaped to mate with the electrically conducting sockets 19 of each of the mating connectors 11. The posts 35 are preferably spaced apart a distance large enough to allow the side-by-side mounting of the series of mating connectors 11. In this embodiment, the mating connectors 11 are stored on the mounting member 33 in an organized, orderly fashion once a particular medical procedure is complete. The mounting member 33 may be conveniently affixed to a convenient location on the monitoring/treatment device.

Alternately, the mounting member 33 may be detachable from the particular monitoring/treatment device, or it may be tethered to the instrument by a light weight line (not shown) of length about equal to the longest lead wire. The mounting member 33 may be labeled or color-coded to facilitate consistent, organized storage of the mating connectors 11.

In a preferred embodiment, the mounting member 33 has ten posts and is made of plastic. The mounting member 33 is shown in FIG. 4 as a straight bar, however it may comprise any one of a variety of shapes and sizes. For example, the mounting member 33 may be curved and/or the non-conductive posts 35 may extend from the mounting member 33 in two or more rows. In another embodiment, the mounting member 33 may comprise a small plate having rows of posts 35 on its upper and lower sides. It will also be recognized by those skilled in the art that the mounting member 33 may comprise posts 39 similar to that shown in FIG. 6, or extensions 47 similar to that shown in FIG. 9. In fact it is conceived that the mounting member 33 may comprise any one of a variety of means for releasably coupling to a series of mating connectors.

Figure 10:
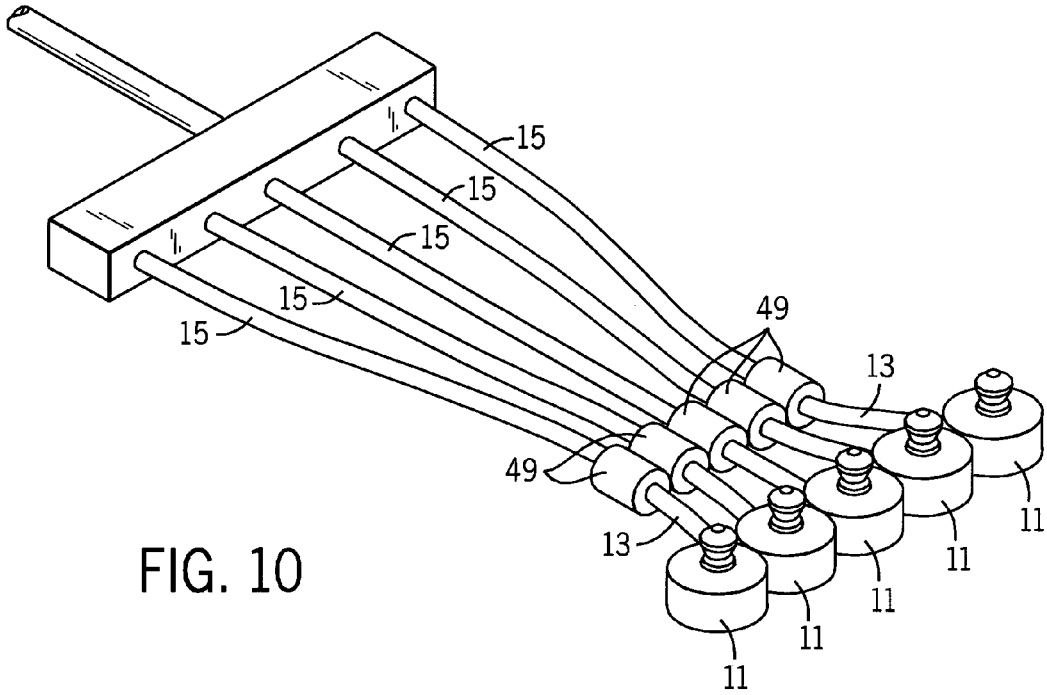
FIG. 10 is a perspective view of another embodiment of the present invention including a plurality of magnets for coupling the free ends of a plurality of lead wires.

Referring now to FIG. 10, an additional feature of the present invention is shown. More specifically, means for attaching the free ends 13 of the lead wires 15, which may comprise a magnetic collar 49 attached to each free end 13. In this embodiment, at the conclusion of use, the caregiver can simply allow the lead wires 15 which were not tangled during use to hang free, causing the magnetic collars 49 to come within proximity of each other and to independently attract and adhere to each other without direct interaction by the caregiver. This arrangement is very convenient for the caregiver because no explicit action is needed to couple the free ends 13 of the lead wires 15 together. When, for example, the arrangement is placed in a storage area, such as a drawer, the lead wires 15 remain untangled as long as the magnetic collars 49 remain attached together.

The magnets 49 can be molded into the lead wires as an integral part or can be accessory devices that are securely attached by the caregiver to the lead wires 15. As an accessory, the magnetic collars 49 may be applied to a wide variety of existing lead wires and may even be transferred from worn out lead wires to new lead wires. Preferably, the magnetic collars 49 are mounted at a small distance, preferably about 2–4 inches, from the mating connector 11. This provides a convenient electrical short-free end for the caregiver to grasp when manipulating the lead wires to attach to the patient.

Figure 11:
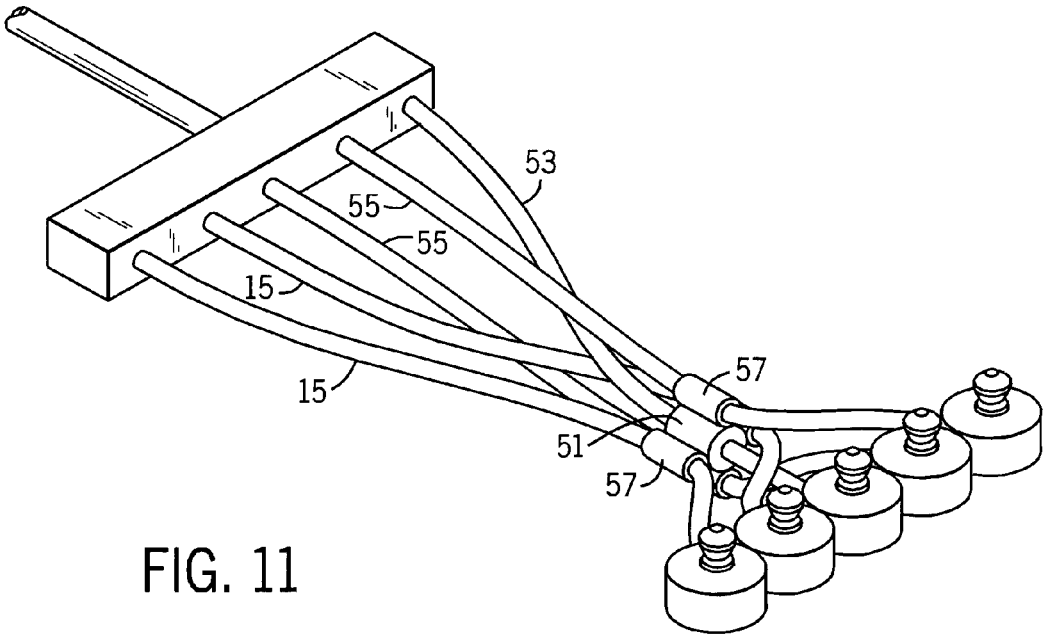
FIG. 11 is a perspective view of another embodiment of the present invention including a single magnet and metal collars for coupling the free ends of a plurality of wires.

Referring now to FIG. 11, an additional feature of the present invention is shown. A magnetic collar 51 is attached to one of the lead wires, preferably the right leg (RL) ECG lead wire 53. The RL ECG lead wire 53 is conventionally not a sensing lead wire, meaning that no standard ECG signals depend on voltages sensed through this lead wire. As such, it is less likely that the magnetic collar 51 will adversely affect the quality of the ECG signals. The remaining lead wires 55 have a metal collar 57, preferably formed of steel, attached at the same relative position from the end of the lead wire 55 as the position of the magnetic collar 51 from the end of the RL ECG lead wire 53. Because there is only one magnetic collar 51, magnetic pole orientation cannot repel the other lead wires 55. This arrangement facilitates a compact automatic arrangement when lead wires are not in use and a design of reduced overall weight and size.

While this invention is susceptible to embodiments in many different forms, the drawings and specification describe in detail a preferred embodiment of the invention. They are not intended to limit the broad aspects of the invention to the embodiment illustrated.

What is claimed is:

1. An arrangement for preventing lead wires used with a patient monitoring or treatment device from becoming tangled, the arrangement comprising:

a plurality of electrically conductive lead wires, each having a fixed end and a free end, the fixed end being configured to be electrically coupled to the patient monitoring or treatment device; and a mating connector coupled to the free end of each of the plurality of electrically conductive lead wires, each mating connector having an electrically conducting socket for receiving an electrode and an electrically non-conducting post that is mateable with the electrically conducting socket on another of the mating connectors to attach the free ends of at least two of the plurality of electrically conductive lead wires together.

2. The arrangement of claim 1, wherein the patient monitoring device is an electrocardiograph machine.

3. The arrangement of claim 1, wherein the electronically non-conducting post has substantially the same shape as an electrode post on the electrode.

4. The arrangement of claim 1, further comprising a mounting member that is mateable with the mating connectors to store the mating connectors during periods of nonuse.

5. The arrangement of claim 1, wherein the mounting member is color-coded according to standard electrode position color codes.

6. An arrangement for preventing lead wires used with a patient monitoring or treatment device from becoming tangled, the arrangement comprising:

a plurality of electrically conductive lead wires, each having a fixed end and a free end, the fixed end being configured to be electrically coupled to the patient monitoring or treatment device;

a magnet coupled to the free end of one of the lead wires, a metal collar coupled to the free end of one or more of the remaining lead wires, wherein the magnet and metal collar passively cohere the free ends of the plurality of lead wires together to prevent tangling during periods of nonuse; and a mating connector coupled to the free end of each of the plurality of electrically conductive lead wires, each mating connector being electrically mateable with an electrode and also being mateable with another mating connector to attach the free ends of at least two of the plurality of electrically conductive lead wires together.

7. The arrangement of claim 6, wherein the metal collar is formed of steel.

8. An arrangement for preventing lead wires used with a patient monitoring device from becoming tangled, the arrangement comprising:

a plurality of electrically conductive lead wires, each having a fixed end and a free end, the fixed end being configured to be electrically coupled to the patient monitoring or treatment device;

a mating connector coupled to the free end of each of the electrically conductive lead wires, each mating connector being mateable with an electrode; and a mounting member, the mounting member having means for releasably connecting to each of the mating connectors to store the mating connectors during periods of non-use;

wherein the mounting member comprises a plurality of non-conductive posts, and each mating connector comprises a cavity sized to receive the non-conductive post, to releasably couple the mating connector to the mounting member;

wherein the non-conductive post is received by the cavity in a snap-fit connection.

9. The arrangement of claim 8, wherein the mounting member is disposed on the patient monitoring device.

10. The arrangement of claim 8 wherein the cavity is sized to receive an electrode to permit the electrode to be in electrical communication with the lead wire.

11. An arrangement for preventing lead wires used with a patient monitoring device from becoming tangled, the arrangement comprising:

a plurality of electrically conductive lead wires, each having a fixed end and a free end, the fixed end being configured to be electrically coupled to the patient monitoring or treatment device;

a mating connector coupled to the free end of each of the electrically conductive lead wires, each mating connector being mateable with an electrode; and a mounting member, the mounting member having means for releasably connecting to each of the mating connectors to store the mating connectors during periods of non-use;

wherein each mating connector comprises a non-conducting post that is mateable with a cavity formed in the mounting member.

* * * * *